US011175117B2

(12) United States Patent
Bavanari et al.

(10) Patent No.: US 11,175,117 B2
(45) Date of Patent: Nov. 16, 2021

(54) BI-DIRECTIONAL WING UNFOLDING MECHANISM

(71) Applicant: CHAIRMAN, DEFENCE RESEARCH & DEVELOPMENT ORGANISATION (DRDO), New Delhi (IN)

(72) Inventors: Venkata Lakshmi Chennakeseva Rao Bavanari, Kanchanbagh Hyderabad (IN); Ismail Shaik, Kanchanbagh Hyderabad (IN); Prakash Jain, Kanchanbagh Hyderabad (IN); Seeta Rama Anjaneyulu Pamarthi, Kanchanbagh Hyderabad (IN); Naveed Ali, Kanchanbagh Hyderabad (IN); Ranajit Das, Kanchanbagh Hyderabad (IN); Kaikobad Erachshaw Kapadia, Kanchanbagh Hyderabad (IN)

(73) Assignee: CHAIRMAN, DEFENCE RESEARCH & DEVELOPMENT ORGANISATION (DRDO), New Delhi (IN)

( * ) Notice: Subject to any disclaimer, the term of this patent is extended or adjusted under 35 U.S.C. 154(b) by 272 days.

(21) Appl. No.: 16/319,176

(22) PCT Filed: Jul. 11, 2017

(86) PCT No.: PCT/IB2017/054165
§ 371 (c)(1),
(2) Date: Jan. 18, 2019

(87) PCT Pub. No.: WO2018/015838
PCT Pub. Date: Jan. 25, 2018

(65) Prior Publication Data

US 2019/0154420 A1 May 23, 2019

(30) Foreign Application Priority Data

Jul. 21, 2016 (IN) ..... 201611024976

(51) Int. Cl.
*F42B 10/14* (2006.01)

(52) U.S. Cl.
CPC ..... *F42B 10/14* (2013.01)

(58) Field of Classification Search
CPC ..... F24B 10/14; B64C 3/56
See application file for complete search history.

(56) References Cited

U.S. PATENT DOCUMENTS 3,063,375 A * 11/1962 Hawley ..... F42B 10/14 244/3.27
3,602,459 A * 8/1971 Pesarini ..... F42B 10/14 244/3.27

(Continued)

*Primary Examiner* — Richard R. Green
*Assistant Examiner* — Madison Elizabeth Dittner
(74) *Attorney, Agent, or Firm* — Nath, Goldberg & Meyer; Joshua B. Goldberg

(57) ABSTRACT

The present disclosure relates to a bi-directional wing unfolding mechanism for unfolding and locking wings of air vehicle during deployment. The mechanism comprises one or more flexible member to enable lift and rotational movements of the wings of air vehicle about one or more axis. The mechanism also comprises one or more pairs of lock pins to lock undesired lift and rotational movement of the wings after the desired movements, thereby enabling minimum roll disturbance and near synchronous locking of all wings. Further, the mechanism also enables folding and unfolding of the wings having higher aspect ratio by folding and unfolding at mutually perpendicular axes. The mechanism also enables lower drag and results in high aerodynamic performance, low roll rate and better flight trajectory.

7 Claims, 4 Drawing Sheets

(56) References Cited

U.S. PATENT DOCUMENTS

| | | | | |
|---|---|---|---|---|
| 4,323,208 | A * | 4/1982 | Ball | F42B 10/14 244/3.28 |
| 4,664,339 | A * | 5/1987 | Crossfield | F42B 10/14 244/3.28 |
| 4,667,899 | A * | 5/1987 | Wedertz | F42B 10/14 244/218 |
| 4,869,442 | A * | 9/1989 | Miller | F42B 10/14 244/3.28 |
| 5,326,049 | A | 7/1994 | Rom et al. | |
| 5,762,294 | A * | 6/1998 | Jimmerson | F42B 10/14 244/3.27 |
| 6,092,264 | A * | 7/2000 | Banks | F42B 10/14 16/289 |
| 6,761,331 | B2 * | 7/2004 | Eisentraut | F42B 10/14 244/3.28 |
| 7,059,561 | B2 * | 6/2006 | Trouillot | F42B 10/14 244/3.28 |
| 2004/0144888 | A1 | 7/2004 | Dryer et al. | |

* cited by examiner

BI-DIRECTIONAL WING UNFOLDING MECHANISM

TECHNICAL FIELD

The present disclosure relates to mechanism for unfolding and fixing wings of flying vehicles, more particularly, the disclosure relates to an improved mechanism for unfolding and fixing wings of flying vehicles when launching from a launch tube or canister.

BACKGROUND

Figure 1:
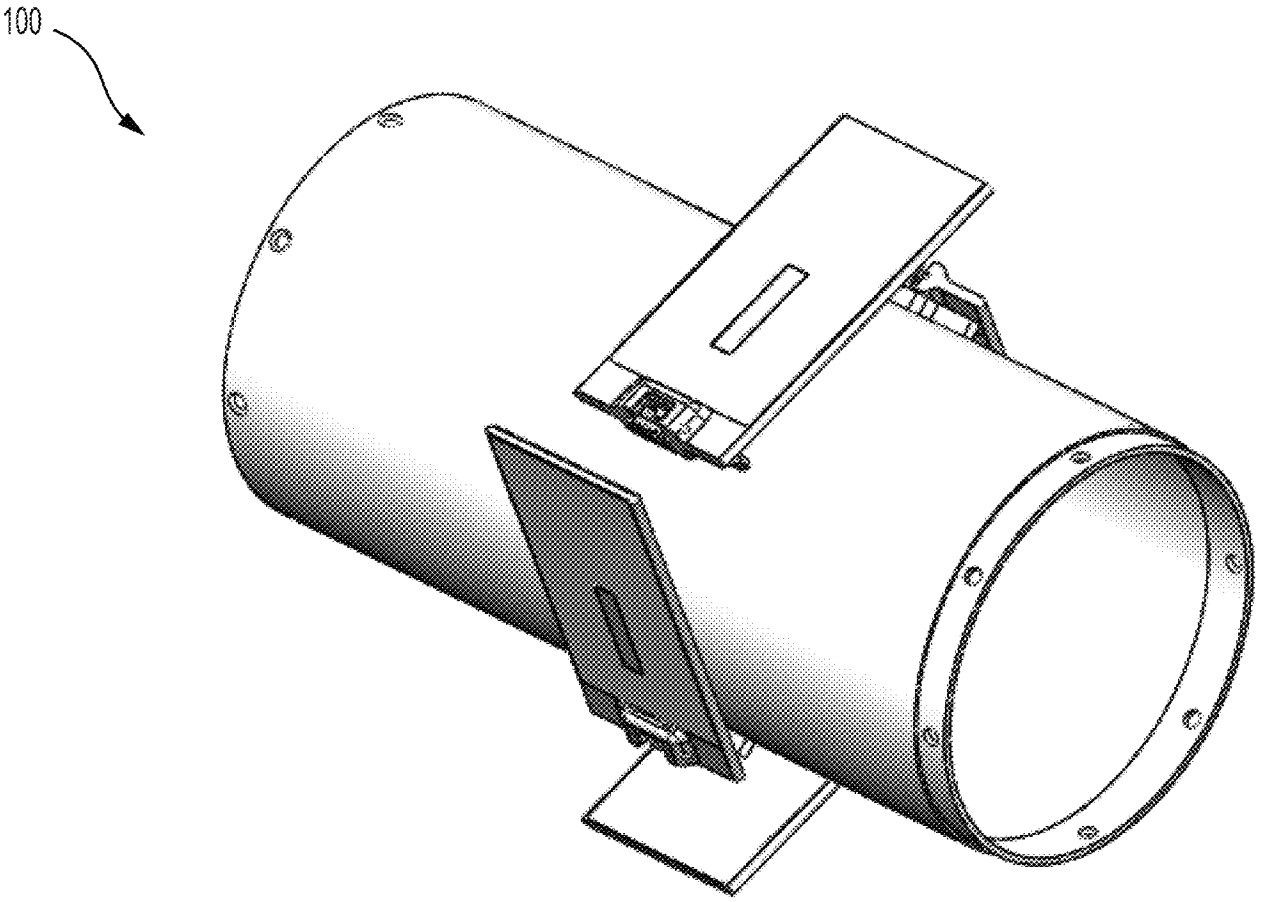
FIG. 1 (PRIOR ART)

Generally, flying objects or vehicles are loaded in a launch tube or canister for configuration and testing purposes. After the flying object is launched from the launch tube or canister, the wings of the flying object are rapidly unfolded and fixed, so that the flying of the flying object is guided by the wings fixed to the outer surface thereof. Typically, the wings of the flying object are folded about longitudinal axis of the flying object forming a bigger envelope or the launch tube as illustrated in FIG. 1. The conventional folding scheme suits wings of low aspect ratio, however as the aspect ratio of the wings increase, the conventional folding scheme results in larger diameters of the launch tube. Further, conventional folding scheme is also sensitive to drift wind forces and fails to achieve simultaneous locking of the wings thereby resulting in greater roll disturbance and hence poor aerodynamic performance of the flying object.

Other features and advantages of the invention will be apparent from the following detailed description of the preferred embodiments thereof and from the claims, taken in conjunction with the accompanying drawings.

SUMMARY OF THE DISCLOSURE

The shortcomings of the prior art are overcome and the additional advantages are provided through the provision of method and product as claimed in the present disclosure.

Additional features and advantages can be realized through the techniques of the present disclosure. Other embodiments and aspects of the disclosure are described in detail herein and are considered as a part of the claimed disclosure.

Accordingly, the present disclosure relates to a mechanism for unfolding wings of air vehicles. The mechanism comprises at least a plurality of wings. Each wing comprises a first part fixed to the body of the air vehicles and a second part pivotally supported by the first part. The mechanism also comprises a bracket attached to both the first and the second part of the plurality of wings at the center, for enabling the lift and rotational movements of the plurality of wings. The mechanism further comprises an unfolding and locking assembly comprising at least a first pre-stressed flexible member for lifting the second part of the plurality of wings about a first pivot axis and a first locking member for locking the lift movement of the plurality of wings with the bracket after the second part of the plurality of wings has pivoted about the first pivot axis. The unfolding and locking assembly further comprises a second flexible member that is pre-stressed in the fully folded condition to produce an initial moment tending to pivot the second part of the plurality of wings about a second pivot axis. Furthermore, the unfolding and locking assembly comprises a second locking member for locking the plurality of wings when received in a socket member after the second part of the plurality of wings has pivoted about the second pivot axis.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE ACCOMPANYING FIGURES

Figure 2A:
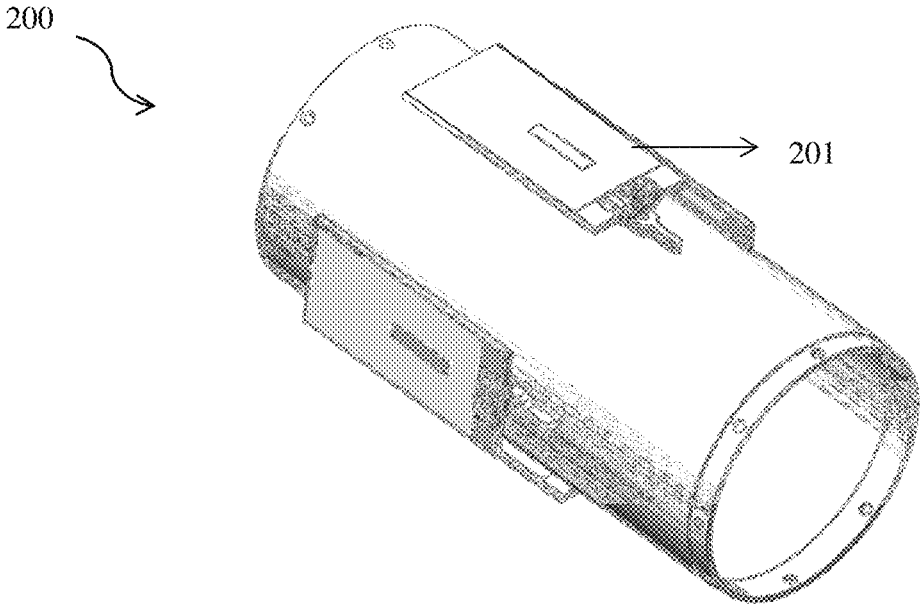
Figure 2B:
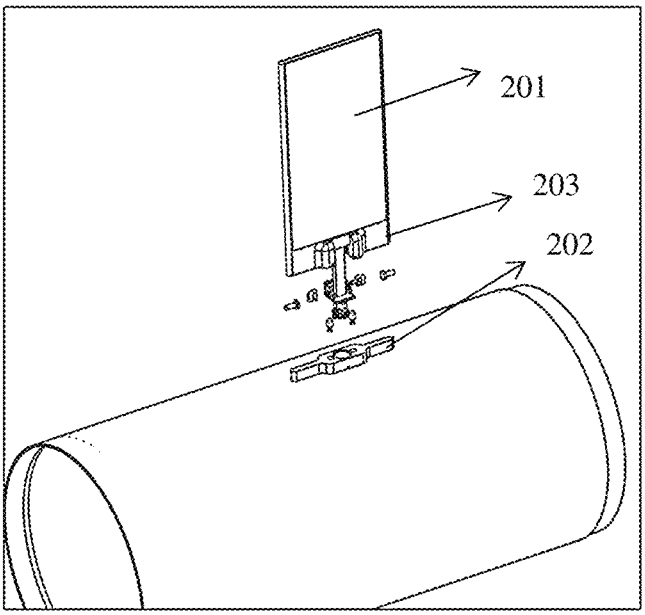
Figure 3A:
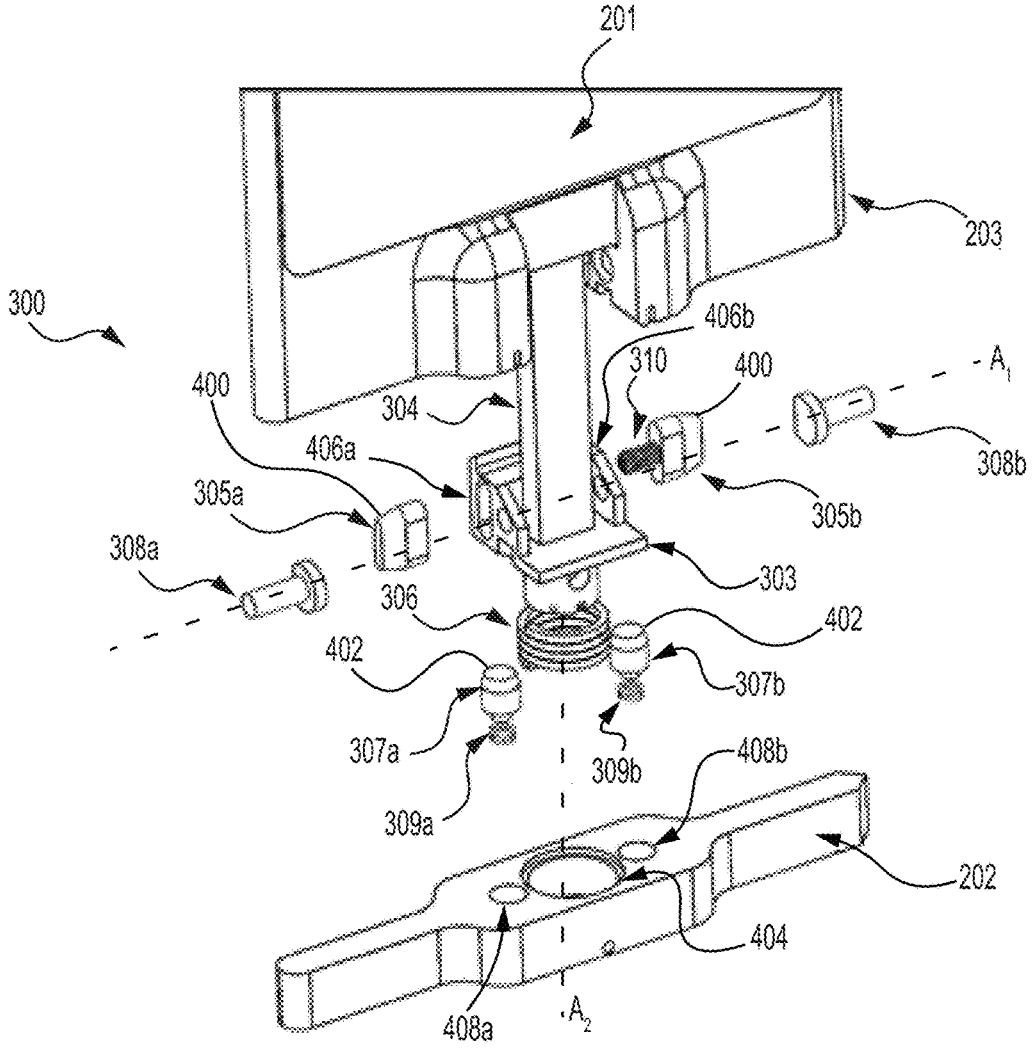
Figures 3B, 3C, 3D, 3E:
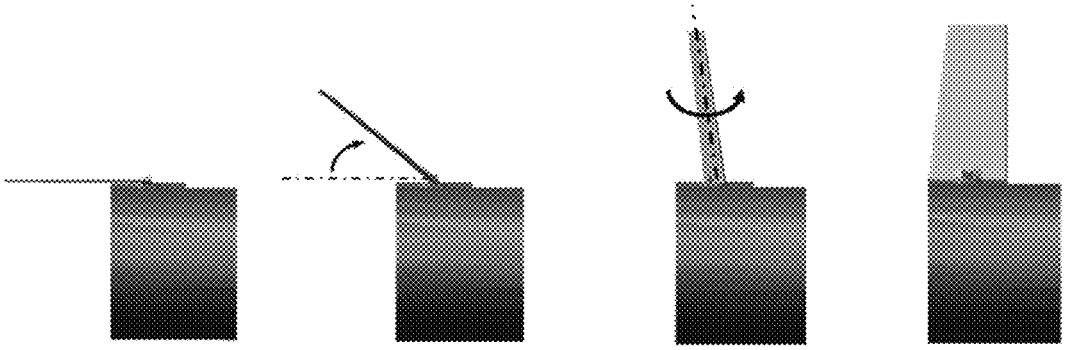
Figure 4:
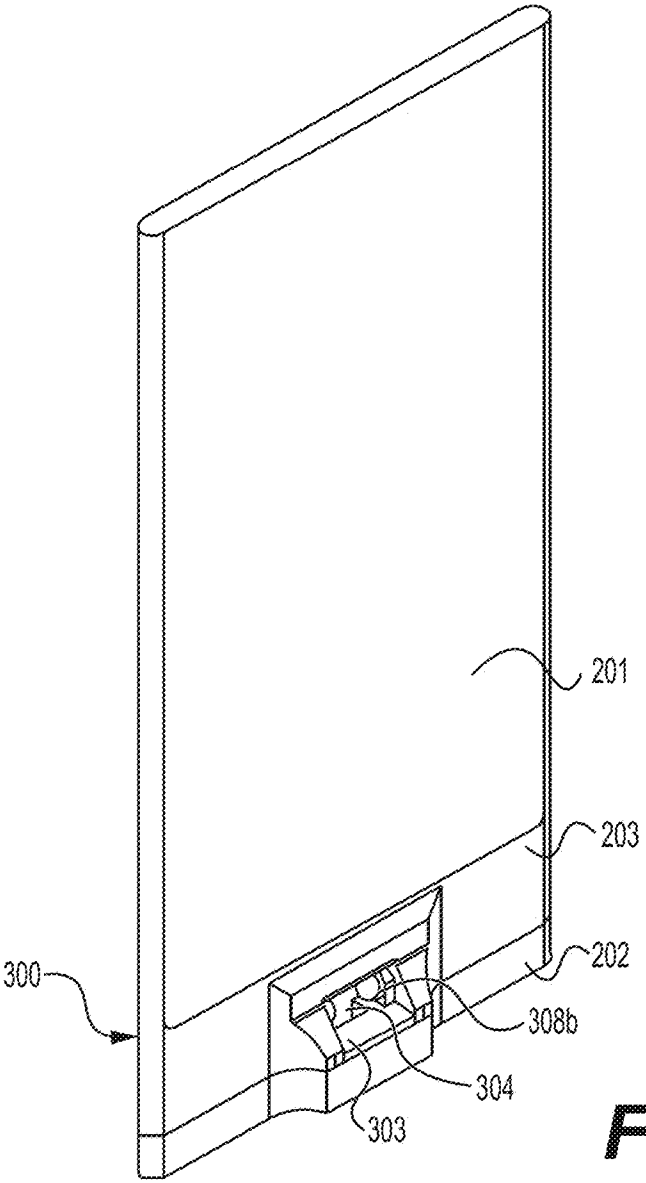

The salient features and characteristics of the disclosure are explained herein. The embodiments of the disclosure itself, however, as well as a preferred mode of use, further objectives and advantages thereof, will best be understood by reference to the following detailed description of an illustrative embodiment when read in conjunction with the accompanying drawings. One or more embodiments are now described, by way of example only, with reference to the accompanying drawings in which:

FIG. 1 illustrates a conventional folding scheme of air vehicle when loaded in the canister or launch tube;

FIG. 2*a* illustrates an exemplary air vehicle with wings in folded condition in accordance with an embodiment of the present disclosure;

FIG. 2*b* illustrates exploded view of the unfolding and locking mechanism of the wings in accordance with another embodiment of the present disclosure;

FIG. 3*a* illustrates another exploded perspective of the unfolding and locking mechanism of wings of air vehicles in accordance with an embodiment of the present disclosure;

FIGS. 3*b*, 3*c*, 3*d* and 3*e* illustrate a sequence of unfolding of wing in accordance with an embodiment of the present disclosure; and FIG. 4 is a perspective view of the unfolding and locking mechanism of wings of air vehicles.

The figures depict embodiments of the disclosure for purposes of illustration only. One skilled in the art will readily recognize from the following description that alternative embodiments of the structures and methods illustrated herein may be employed without departing from the principles of the disclosure described herein.

DETAILED DESCRIPTION

The foregoing has broadly outlined the features and technical advantages of the present disclosure in order that the detailed description of the disclosure that follows may be better understood. Additional features and advantages of the disclosure will be described hereinafter which form the subject of the claims of the disclosure. It should be appreciated by those skilled in the art that the conception and specific embodiment disclosed may be readily utilized as a basis for modifying or designing other structures for carrying out the same purposes of the present disclosure. It should also be realized by those skilled in the art that such equivalent constructions do not depart from the spirit and scope of the disclosure as set forth in the appended claims. The novel features which are believed to be characteristic of the disclosure, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present disclosure.

The present disclosure relates to a bi-directional wing unfolding mechanism for automatically unfolding wings of air vehicle. As illustrated in FIG. 2*a*, the air vehicle (200) comprises a plurality of wings (201) folded along the longitudinal axis of the air vehicle. In one embodiment, the plurality of wings (201) comprises of two parts, such as a first part (202) fixed to the body of the air vehicle and a second part (203) pivotally supported by the first part (202). During deployment, the second part (203) of the plurality of wings (201) is unfolded and locked about mutually perpendicular axis as illustrated in FIG. 2*b*.

In one embodiment, the plurality of wings (201) is unfolded using a wing unfolding and locking assembly (300) for deployment. As illustrated in FIG. 3*a* and FIG. 4, the wing unfolding and locking assembly or mechanism (300) comprises at least a bracket (303) attached to both the first part (202) and the second part (203) of the plurality of wings (201) at the centre. The bracket (303) is configured as hinge with a hinge shaft to enable the lift and rotational movements of the plurality of wings (201).

The wing unfolding and locking assembly (300) also comprises a first flexible member (304) coupled with the second part (203) and the hinge shaft of the bracket (303). In one example, the first flexible member (304) may be a leaf spring or a carriage spring having a stack of thin strips of steel disposed within the hinge shaft of the bracket (303). The first flexible member (304) is configured to perform lifting of the second part (203) of the plurality of wings (201) about a first pivot axis $A_1$. In one embodiment, the second part (203) of the plurality of wings (201) is lifted about the first pivot axis $A_1$ in the range of 85 to 92 degree. After predetermined lifting of the second part (203) of the plurality of wings (201) about the first pivot axis $A_1$, further lift movement is prevented by a first locking member (400) attached to the bracket (303). The first locking member (400) comprises a pair of first lock pins (305*a*, 305*b*) placed in the bracket (303) and that partially enters into a pair of corresponding blind holes (406*a*, 406*b*) configured in the second part (203) of the plurality of wings (201) to lock further lift movement of the second part (203).

The wing unfolding and locking assembly (300) further comprises a second flexible member (306) that is prestressed in the fully folded condition to produce an initial moment tending to pivot the second part (203) of the plurality of wings (201) about a second pivot axis $A_2$. In one example, the second flexible member (306) may be a helical torsion spring of square wire, inserted into a groove formed in the outer surface of a socket member (404) of the first part (202) of the plurality of wings (201). After predetermined rotation of the second part (203) of the plurality of wings (201) about the second pivot axis $A_2$ by releasing the compressed spring from the fully folded condition, further rotation of the second part (203) is prevented by a second locking member (402) placed in the first part (202) of the plurality of wings (201). In one embodiment, the second locking member (402) comprises a pair of second lock pins (307*a*, 307*b*) placed in the first part (202) of the plurality of wings (201) and that partially enters into a pair of corresponding blind holes (408*a*, 408*b*) configured in the socket member (404) of the first part (202) for locking the rotation of the second part (203) of the plurality of wings (201). The socket member (404) is configured on the first part (202) of the plurality of wings (201) for receiving the second flexible member (306) after the second part (203) of the plurality of wings (201) is pivoted about the second pivot axis $A_2$. In one embodiment, the second part (203) of the plurality of wings (201) is rotated about the second pivot axis $A_2$ by 90 degrees.

The unfolding and locking assembly (300) further comprises a pair of hinge pins (308*a*, 308*b*) attached to the bracket (303) for enabling lift and rotational movement of the second part (203) of the plurality of wings (201) about the pair of hinge pins (308*a*, 308*b*).

In operation, the plurality of wings (201) of the air vehicle is in folded configuration, as illustrated in FIG. 3*b*, when loaded inside the launch tube. During the movement of the air vehicle (200) for deployment outside the canister or launch tube, the first flexible member (304) performs the lifting operation, as illustrated in FIG. 3*c*, to lift the second part (203) of the plurality of wings (201) along the first pivot axis. During the lifting operation, the plurality of wings (201) also rotates marginally by for example 5 degree as the stiffness of designed leaf spring is much higher than torsion spring. Upon completion of the lifting operation, the first locking member enables the locking of the plurality of wings (201) to prevent further lifting. In one embodiment, the first lock pins (305*a*, 305*b*) partially enters into corresponding blind holes of the bracket (303) under the influence of force provided by compression spring (310) and engages with the bracket (303) thereby limiting further lifting movement of the plurality of wings (201).

After the plurality of wings (201) is locked from lifting further, the plurality of wings (201) is rotated about the second pivot axis $A_2$ by the second flexible member (306) as illustrated in FIG. 3*d*. The second part (202) of the plurality of wings (201) is rotated by the torsion spring along with the bracket (303) about the second pivot axis $A_2$. Upon completion of the rotation, the bracket (303) and the second part (203) of the plurality of wings (201) is locked by the second lock pins (307*a*, 307*b*) under the influence of force provided by compression springs (309*a*, 309*b*) engaged into corresponding holes configured in the first part (202) of the plurality of wings (201). Thus, the plurality of wing (201) is completely locked from lift and rotational movements and available in the deployed position as illustrated in FIG. 3*e*. Thus, the unfolding and locking assembly (300) is configured to automatically unfold and lock the plurality of wings (201) in predetermined time duration during the deployment.

The sequence of unfolding the plurality of wings (201) as disclosed in FIGS. 3*b*-3*e* clearly depicts the lifting the plurality of wings (201) ahead of rotational movements. The advantage of lifting the plurality of wings (201) ahead of rotation is to utilise the available aerodynamic drag force caused by wind to unfold the wing in the lift direction, without involving additional or external lift force to be exerted which in turn would require additional gears adding more weight on the mechanism and thereby reducing the aerodynamic performance of the vehicle.

ADVANTAGES OF THE PRESENT DISCLOSURE

- The disclosed research work enables folding and unfolding of high aspect ratio wings by folding and unfolding wing simultaneously about two mutually perpendicular axes thereby avoiding the need of having launch tube of huge diameter.
- The unfolding mechanism also enables near synchronous locking of all wings.
- The unfolding mechanism enables minimum roll disturbance due to wing locking.

The disclosed mechanism enables lower drag and therefore results in high aerodynamic performance, low roll rate and better flight trajectory.

EQUIVALENTS

With respect to the use of substantially any plural and/or singular terms herein, those having skill in the art can translate from the plural to the singular and/or from the singular to the plural as is appropriate to the context and/or application. The various singular/plural permutations may be expressly set forth herein for the sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances, where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

REFERENCE NUMERALS

100—Conventional wing folding scheme
200—Air vehicle
201—Wings
202—First part of wing
203—Second part of wing
300—Wing Unfolding and Locking assembly
303—Bracket
304—First flexible member
305*a*, 305*b*—First Lock pins
306—Second flexible member
307*a*, 307*b*—Second Lock pins
308*a*, 308*b*—Hinge pins
309*a*, 309*b*—Compression Springs for second lock pins
310—Compression Spring for first lock pins

We claim:

1. A mechanism for unfolding wings (201) of air vehicles (200), comprising:

a plurality of wings (201), each comprising a first part (202) fixed to a body of the air vehicles and a second part (203) pivotally supported by the first part (202); and an unfolding and locking assembly (300), comprising at least:

a bracket (303) attached to both the first part (202) and the second part (203) of the plurality of wings (201) at a center;

a first flexible member (304) pre-stressed for lifting the second part (203) of the plurality of wings (201) about a first pivot axis;

a first locking member for locking a lift movement of the plurality of wings (201) with the bracket (303) after the second part (203) of the plurality of wings (201) has pivoted about the first pivot axis;

a second flexible member (306) pre-stressed in a fully folded condition to produce an initial moment tending to pivot the second part (203) of the plurality of wings (201) about a second pivot axis; and a second locking member for locking the plurality of wings (201), the second locking member being received in a socket member of the first part (202), the second locking member selectively locking the second part (203) of the plurality of wings (201) with respect to pivoting thereof about the second pivot axis, wherein the socket member receives the second flexible member (306).

2. The mechanism as claimed in claim 1, wherein the unfolding and locking assembly (300) further comprises a pair of hinge pins (308*a*, 308*b*) pivotally attaching the first flexible member (304) to the bracket (303) for enabling lift and rotational movement of the second part (203) of the plurality of wings (201) about the pair of hinge pins (308*a*, 308*b*).

3. The mechanism as claimed in claim 1, wherein the first flexible member (304) is a leaf spring.

4. The mechanism as claimed in claim 1, wherein the second flexible member (306) is a prestressed torsion spring.

5. The mechanism as claimed in claim 1, wherein the second part (203) of the plurality of wings (201) is lifted about the first pivot axis in the range of 85 to 92 degrees.

6. The mechanism as claimed in claim 1, wherein the second part (203) of the plurality of wings (201) is rotated about the second pivot axis by 90 degrees.

7. The mechanism as claimed in claim 1, wherein the first pivot axis and the second pivot axis are mutually perpendicular to each other.

* * * * *